United States Patent [19]

Ulrich et al.

[11] 4,389,040

[45] Jun. 21, 1983

[54] APPARATUS FOR SEPARATING A SPONGE IRON PRODUCT PRODUCED IN A ROTARY FURNACE

[75] Inventors: Klaus Ulrich, Heiligenhaus; Wilhelm Janssen, Mülheim; Reinhard Herbrig, Duisburg, all of Fed. Rep. of Germany

[73] Assignee: Fried. Krupp Gesellschaft mit beschränkter Haftung, Essen, Fed. Rep. of Germany

[21] Appl. No.: 387,540

[22] Filed: Jun. 11, 1982

[30] Foreign Application Priority Data

Jun. 13, 1981 [DE] Fed. Rep. of Germany ..... 3123589

[51] Int. Cl.[3] ..... F27B 7/32

[52] U.S. Cl. ..... 266/137; 266/173

[58] Field of Search ..... 266/173, 137

[56] References Cited

U.S. PATENT DOCUMENTS 3,892,044 7/1975 Kayatz ..... 34/20

4,304,597 12/1981 Keran et al. ..... 266/173

FOREIGN PATENT DOCUMENTS 183008 8/1955 Austria .

302604 11/1915 Fed. Rep. of Germany .

1215937 12/1966 Fed. Rep. of Germany .

1433342 6/1969 Fed. Rep. of Germany .

796224 4/1936 France .

114306 7/1975 German Democratic Rep. .

*Primary Examiner*—M. J. Andrews

*Attorney, Agent, or Firm*—Spencer & Kaye

[57] ABSTRACT

An apparatus for separating sponge iron products from the hot discharge material of a rotary furnace. A discharge chamber is connected to the rotary furnace for receiving the hot discharge material from the rotary furnace. A screen is provided at the lower end of the discharge chamber for separating the sponge iron products from the hot discharge material. The screen is attached to a support which is removably sealed to the lower end of the discharge chamber and is provided with a mechanism for displacing the support and attached screen. The support includes a discharge chute connected beneath the screen for carrying away the material which passes through the screen and is provided with cooling means.

12 Claims, 3 Drawing Figures

APPARATUS FOR SEPARATING A SPONGE IRON PRODUCT PRODUCED IN A ROTARY FURNACE

BACKGROUND OF THE INVENTION

The present invention relates to an apparatus for separating a sponge iron product from the discharge material of a rotary furnace by screening the sponge iron product from the discharge in a hot condition and in the absence of air.

A rotary furnace generally discharges a mixture of sponge iron, excess coal, desulfuring agent and ash at temperatures between 800° and 1100° C. In the usual prior art processing apparatus the discharge is cooled in a cooling drum to temperature between 80° and 150° C. by indirect and direct water cooling. The sponge iron is then separated from the accompanying non-magnetic materials usually by sifting and subsequent magnetic separation. The cold sponge iron is then fed into an electric furnace for further processing.

A major disadvantage of the prior art apparatus is that the cooling of the sponge iron results in a considerable amount of energy loss since the sponge iron must be heated in an electrical furnace after separation. Although it has long been sought to avoid this drawback, a hot charging of sponge iron into the electrical furnace has been used in practice only for products produced in a shaft furnace by reduction with gases where thus separation or other subsequent treatment of the intermediate product was not required.

Several proposals for the hot screening of the discharge from a rotary furnace have become known which, however, have not been accepted in practice because of the rapid breakdown of the apparatus due to severe wear. Such an apparatus is disclosed, for example, in German Pat. No. 1,215,937, where the input end of a cooling drum following the rotary furnace includes a screening drum arranged in a manner that only the material passing through the screen can enter the cooling drum and material that has not passed through the screen is discharged into an after-connected processing assembly. It is a significant disadvantage of this and other prior art devices that the entire rotary furnace system must be shut down, regardless of whether there occurs a malfunction in the separating apparatus due to high loads or a malfunction in the after-connected melting assembly. Having to shut down the entire system proves to be extremely costly.

SUMMARY OF THE INVENTION

It is an object of the invention to provide an apparatus of the above-outlined type from which the discussed disadvantages are eliminated and which permits a rapid replacement or removal of the hot screen.

This object and others to become apparent as the specification progresses are accomplished by the invention, according to which, briefly stated, the apparatus for the hot separation of sponge iron from the hot discharge material of a rotary furnace has a discharge chamber connected to the discharge end of the rotary furnace; a vibratory screen positioned at a lower end of the discharge chamber for receiving the discharge material from the discharge chamber; a cooled support structure for carrying the vibratory screen; a sealing arrangement for sealing the vibratory screen and the support structure from the ambient environment; an arrangement for moving the support structure with respect to the lower end of the discharge chamber; a screen drive operatively connected to the vibratory screen and carried by the support structure; and a discharge chute carried by the support structure and disposed underneath the screen for discharging the portion of the hot discharge material which passes through the screen.

It is an advantage of the invention that the entire steel production process can be made highly flexible. Thus, in case of a malfunction in the downstream melting assembly all of the sponge iron can be cooled and then temporarily stored and, if necessary, the screen can also be removed.

The high discharge temperatures of sponge iron, which lie between 600° and 1000° C., preferably above 800° C., can be substantially maintained in the hot screening according to the invention so that the susequent hot charging into the electrical furnace is economically feasible.

A BRIEF DESCRIPTION OF THE DRAWINGS

DESCRIPTION OF THE PREFERRED EMBODIMENTS

Figure 1:
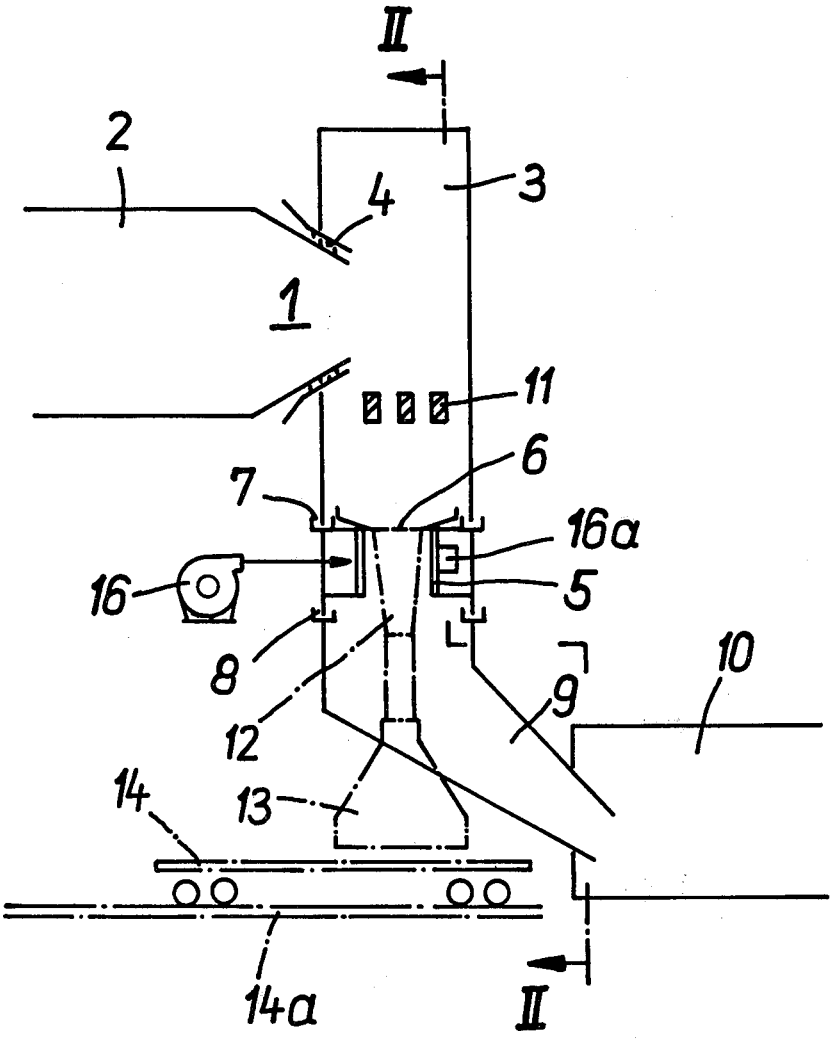
FIG. 1 is a schematic vertical sectional view of the apparatus according to the present invention.
Figure 2:
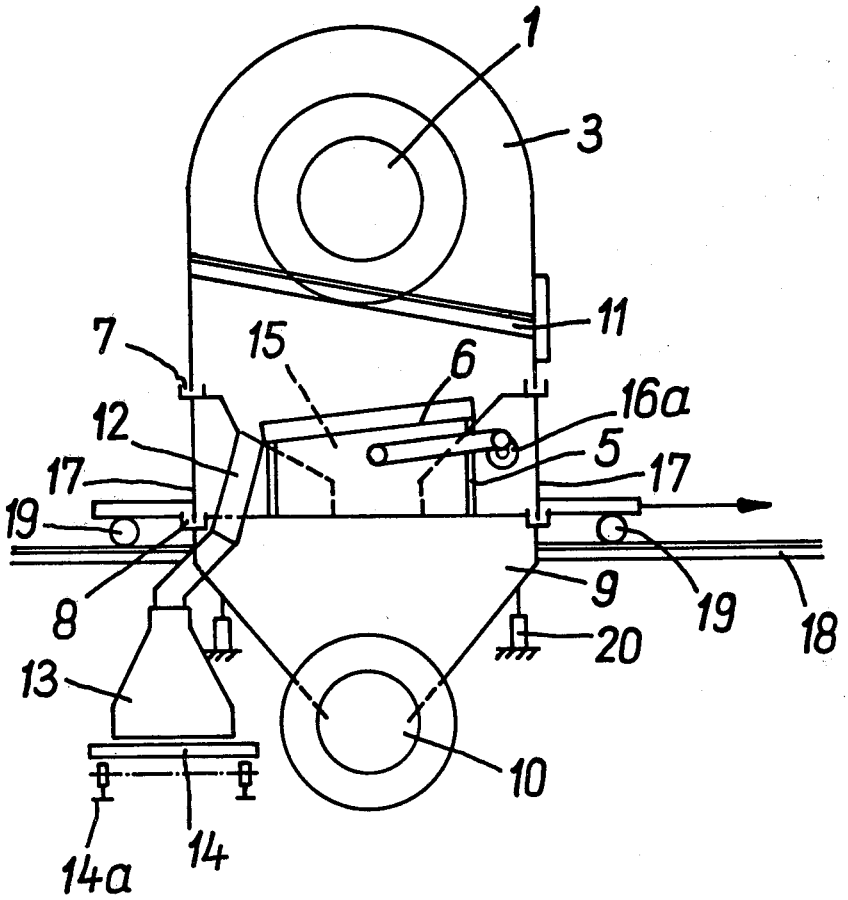
FIG. 2 is a schematic sectional view along line II—II of the FIG. 1.

Turning now to FIGS. 1 and 2, there is illustrated a rotary furnace 2, having a discharge end 1 which extends into a discharge chamber 3. A labyrinth seal 4 is provided for sealing the discharge chamber to the rotary furnace. A vibratory screen 6 is positioned below the discharge member 3, for receiving the hot discharge material from the rotary furnace. The screen 6 is supported by a box-like understructure 5. At the outer upper edges of the understructure 5, there is disposed a seal in the form of a U-shaped sand cup 7 which is oriented in a horizontal plane and which is filled with sand. The lower end of the outer walls of discharge chamber 3 penetrate into the sand of the U-shaped sand cup 7 and thus a seal is effected between the inside of the discharge chamber 3 and the surrounding environment. A corresonding U-shaped sand cup 8 is disposed at the upper end of a chute 9 which is positioned underneath the understructure 5. The discharge end of chute 9 opens into a cooling drum 10.

The materials leaving the discharge end 1 of the furnace 2 first pass through a coarse grate 11, which is disposed above screen 6 in discharge chamber 3 for removing large pieces of material from the hot discharge material. Then the hot discharge material drops onto the vibratory screen 6 which has a mesh size in the range of 2–7 mm, for example, 4 mm, to thus retain most of the sponge iron and insignificant rests of accompanying materials. A chute 12 is provided adjacent vibratory screen 6 and the sponge iron products separated from the hot discharge material are carried away by chute 12 for further processing. Preferably, the discharge chute 12 opens directly into an electric furnace (not shown) for further processing, however, if local conditions do not permit such an arrangement, a heat insulated transportation vessel 13 may be provided for transporting the separated sponge iron products to the electric furnace. FIG. 1 shows a transportation vessel 13 disposed below chute 12 on a transporting carriage 14 which is movable on a platform 14a for transportation to an electric furnace where it may be loaded into the electric furnace via a crane (likewise not shown).

The materials falling through screen 6 are, in general, excess coal, desulfuring agents such as dolomite or limestone, ashes and trace amounts of sponge iron. Chute 15 is provided below the vibratory screen 6 for receiving the material which passes through the screen. Chute 15 is positioned above chute 9 which is connected to cooling drum 10. The material travels through chute 15 to chute 9 and into cooling drum 10 where it is cooled in a known manner and separated magnetically. The remaining sponge iron, which at most amounts to 20% of the total sponge iron produced, is processed further in the cold state.

The sponge iron which leaves the rotary furnace 2 at temperatures of about 800° to 1100° C. is, in its entire path into the electric furnace, protected against the entry of oxygen from the air by means of known appropriate seals arranged at the transitions between chute 12 and the transporting vessel 13 and between the latter and the electric furnace.

In order to protect the sponge iron against re-oxidation, an atmosphere which may range from reducing to neutral is additionally set in the discharge end of the rotary furnace. This atmosphere is at a slightly higher than ambient pressure in order to relieve the labyrinth seals 4 and in order to provide a safety measure as a safety against other leaks.

The box-shaped interior of the screen understructure 5, through the center of which the chute 15 passes, is charged with cooling air by means of a blower 16. A quantity of air of about 5000 to 10,000 standard $m^3/h$ assures, depending on the size of the system, sufficient protection of the screen and the screen understructure against excess mechanical loads due to thermal stresses. The screen 6 is vibrated by a screen drive 16a which, for providing an effective cooling thereof, is disposed in the stream of air generated by the blower.

At each of its two ends 17, the screen understructure 5 is provided with a running mechanism 19 on rails 18, for providing mobility of the screen 6 and the screen understructure 5 out of the region of the discharge end 1 of the rotary furnace 2, for example, for the purpose of maintenance work. For allowing such a displacement, the chute 9 can be lowered by hydraulic power cylinders 20 (for example, three in number) so as to be clear of the screen understructure 5.

To achieve the movement of the understructure 5 this element is first lowered slightly to release the lower edge of discharge chamber 3. For this purpose the running mechanism 19 is provided with well known hydraulic jacklift devices (not shown).

Figure 3:
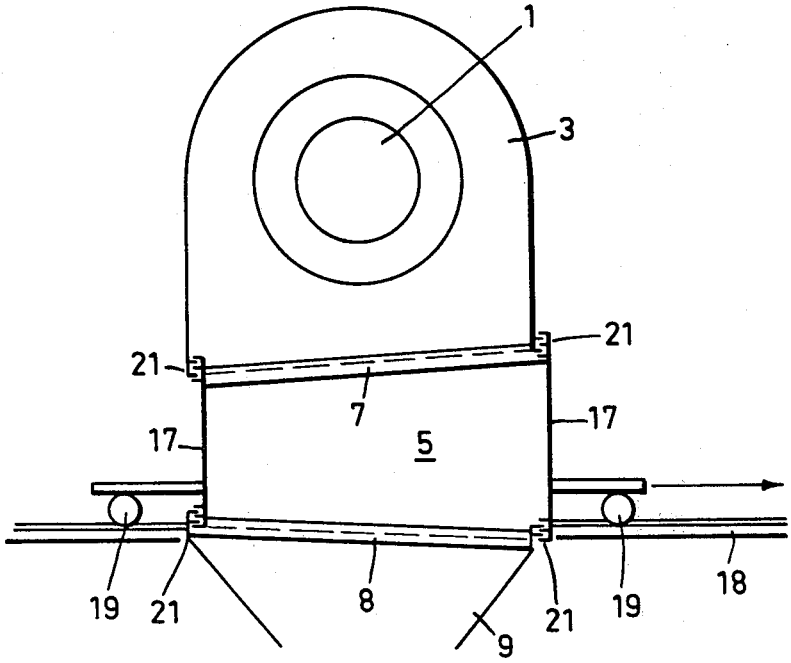
FIG. 3 is a schematic sectional view like FIG. 2 but showing only the walls of the apparatus elements and illustrating a wedge-shaped support means as another embodiment of the apparatus according to the invention.

For a ready replacement of the screen understructure 5 and as an alternative to lowering the chute 9, the contour of the understructure 5 is wedge-shaped, whereby its top and bottom sides are slightly inclined. This arrangement makes it unnecessary to lower the chute 9 for freeing the understructure 5 for its travel. This becomes possible by using labyrinth seals instead of the sand cups 7 and 8 positioned at the two ends 17 respectively in such a manner, that removing in the direction of the enlargement of the wedge angle is allowed. This is illustrated in FIG. 3, showing such labyrinth seals 21 at the edges between the side walls of the box-like understructure 5 and the discharge chamber 3 on the one hand and the chute 9 on the other hand at the two ends 17 respectively.

In case of a shutdown of the electric furnace due to malfunction, the hot sponge iron may be transferred from the transporting vessel 13 into a special cooling assembly and then it may be temporarily stored. Such a mode of operation, however, is not required under certain circumstances, particularly in multi-furnace systems. Particularly in a system where no transporting vessel 13 is provided and the chute 12 opens directly into the electric furnace, in case of a malfunction, either the vibratory screen 6 can be removed or, advantageously, the screen understructure 5 can be replaced by one which is not equipped with a vibratory screen 6 and which is likewise sealed by means of the sand cups 7 and 8. Except for the screened-out oversizes, the entire discharge from the rotary furnace is then fed to the cooling drum 10, processed further and the sponge iron, after it has been separated, is temporarily stored.

It will be understood that the above description of the present invention is susceptible to various modifications, changes and adaptations and the same are intended to be comprehended within the meaning and range of equivalents of the appended claims.

What is claimed is:

1. Apparatus for the hot separation of sponge iron from the hot discharge material of a rotary furnace having a discharge end; comprising a discharge chamber connected to said discharge end of said rotary furnace for receiving hot discharge material from said rotary furnace; a vibratory screen being positioned at a lower end of said discharge chamber for receiving the discharge material from said discharge chamber; support means carrying said vibratory screen; means to cool said support means; sealing means for sealing said vibratory screen and said support means from the ambient environment; means for moving said support means with respect to said lower end of said discharge chamber; screen drive means operatively connected to said vibratory screen and carried by said support means; and a discharge chute carried by said support means and disposed underneath said screen for discharging the portion of the hot discharge material which passes through said screen.

2. The apparatus of claim 1, wherein said means for moving said support means including means providing for a displacement of said support means laterally with respect to said rotary furnace.

3. The apparatus of claim 1, wherein said sealing means comprises a U-shaped channel carried by said support means and sand in said U-shaped channel, said lower end of said discharge chamber comprising a bottom edge, said bottom edge being positioned in said U-shaped channel and surrounded by said sand.

4. The apparatus of claim 1, wherein said support means is box-like in configuration and wherein said discharge chute is positioned within said support means.

5. The apparatus according to claim 1, further comprising a coarse grate positioned within said discharge chamber above said vibratory screen.

6. The apparatus of claim 1, further comprising an additional discharge chute positioned adjacent said vibratory screens for receiving hot discharge material too large to pass through said vibratory screen.

7. The apparatus of claim 1, wherein said vibratory screen has a top surface and a bottom surface and said discharge chute comprises a top opening, a conical shaped side wall and a bottom opening smaller than said top opening; said top opening of said discharge chute being positioned adjacent said bottom surface of said vibratory screen.

8. The apparatus of claim 1, wherein said vibratory screen comprises a mesh screen having a mesh size between 2 and 7 mm.

9. The apparatus of claim 1, wherein said discharge chute is a first discharge chute; further comprising a second discharge chute positioned below said support means and said first discharge chute for receiving discharge material from said first discharge chute; and a cooling drum for cooling hot discharge material; said cooling drum being connected to an outlet of said second discharge chute; said sealing means comprises a U-shaped channel carried by said second discharge chute and sand in said U-shaped channel, said lower end of said discharge chamber comprising a bottom edge, said support means having a bottom edge being positioned in said U-shaped channel and surrounded by said sand.

10. The apparatus of claim 9, further comprising means to adjust the height position of said second discharge chute, relative said support means.

11. The apparatus of claim 1, wherein said furnace has a length dimension, and further wherein said means for moving said support means includes means providing for a displacement of said support means transversely to said length dimension.

12. The apparatus of claim 1, wherein said support means is wedge-shaped, whereby its top and bottom sides are slightly inclined.

* * * * *